US009638029B2

(12) United States Patent
Merino

(10) Patent No.: US 9,638,029 B2
(45) Date of Patent: May 2, 2017

(54) MASTER COMMUNICATION TOOL FOR DISTRIBUTED NETWORK OF WIRELESS COMMUNICATION DEVICES

(71) Applicant: Schlumberger Technology Corporation, Sugar land, TX (US)

(72) Inventor: Carlos Merino, Paris (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 7 days.

(21) Appl. No.: 14/789,978

(22) Filed: Jul. 1, 2015

(65) Prior Publication Data

US 2016/0010447 A1 Jan. 14, 2016

(30) Foreign Application Priority Data

Jul. 10, 2014 (EP) ..... 14290205

(51) Int. Cl.

| | |
|---|---|
| ***E21B 47/12*** | (2012.01) |
| ***E21B 34/06*** | (2006.01) |
| ***E21B 34/16*** | (2006.01) |
| ***E21B 43/00*** | (2006.01) |
| ***E21B 47/14*** | (2006.01) |

(52) U.S. Cl.

CPC ..... *E21B 47/122* (2013.01); *E21B 34/06* (2013.01); *E21B 34/16* (2013.01); *E21B 43/00* (2013.01); *E21B 47/12* (2013.01); *E21B 47/124* (2013.01); *E21B 47/14* (2013.01)

(58) Field of Classification Search

None

See application file for complete search history.

(56) References Cited

U.S. PATENT DOCUMENTS

| | | | |
|---|---|---|---|
| 6,144,316 | A | 11/2000 | Skinner |
| 6,177,882 | B1 | 1/2001 | Ringgenberg et al. |
| 6,470,996 | B1 | 10/2002 | Kyle et al. |
| 6,588,505 | B2 | 7/2003 | Beck et al. |
| 6,912,177 | B2 | 6/2005 | Smith |

(Continued)

FOREIGN PATENT DOCUMENTS

| | | |
|---|---|---|
| EP | 0597704 | 5/1994 |
| EP | 0773345 | 4/2003 |

(Continued)

OTHER PUBLICATIONS

Extended search report for the equivalent European patent application No. 14290205.5 issued on Dec. 18, 2014.

*Primary Examiner* — Mohamed Barakat
(74) *Attorney, Agent, or Firm* — Cameron R. Sneddon

(57) ABSTRACT

A communications path between a surface control system and downhole equipment includes a network of wirelessly interconnected communication devices that are located along a conduit. When the communications path fails or cannot be established during performance of a downhole operation, a mobile master communication tool that is in communication with the surface system can be deployed within the wireless range of one of the devices to provide an alternative communication path between the surface system and the downhole equipment. In other embodiments, the alternative communication path can be a temporary path to provide for communications before the network is fully deployed.

16 Claims, 5 Drawing Sheets

(56) References Cited

U.S. PATENT DOCUMENTS

| | | | | |
|---|---|---|---|---|
| 7,301,472 | B2 | 11/2007 | Kyle et al. | |
| 2001/0042617 | A1 | 11/2001 | Beck et al. | |
| 2006/0203614 | A1* | 9/2006 | Harmon | G01V 1/42 367/57 |
| 2009/0212969 | A1* | 8/2009 | Voss | E21B 33/0355 340/853.1 |
| 2011/0164468 | A1 | 7/2011 | Rubbins et al. | |
| 2011/0192592 | A1* | 8/2011 | Roddy | E21B 47/01 166/250.01 |
| 2011/0205847 | A1* | 8/2011 | Lemenager | E21B 47/16 367/82 |
| 2013/0241742 | A1 | 9/2013 | Contant et al. | |
| 2013/0319102 | A1 | 12/2013 | Ringgenberg et al. | |
| 2014/0233353 | A1 | 8/2014 | Bravard et al. | |

FOREIGN PATENT DOCUMENTS

| | | |
|---|---|---|
| EP | 2157278 | 2/2010 |
| WO | 2012/042499 | 4/2012 |

* cited by examiner

MASTER COMMUNICATION TOOL FOR DISTRIBUTED NETWORK OF WIRELESS COMMUNICATION DEVICES

CROSS REFERENCE TO RELATED APPLICATIONS

This application claims priority to European Patent Application 14290205.5, filed on Jul. 10, 2014, which is herein incorporated by reference.

BACKGROUND

Field

The present disclosure relates to techniques for communicating in downhole environments. More particularly, the present disclosure relates to tools for communicating with a distributed network of wireless communication devices.

Description of the Related Art

Hydrocarbon fluids, including oil and natural gas, can be obtained from a subterranean geologic formation, referred to as a reservoir, by drilling a wellbore that penetrates the formation. Once a wellbore is drilled, various well completion components are installed to enable and control the production of fluids from the reservoir. Data representative of various downhole parameters, such as downhole pressure and temperature, are often monitored and communicated to the surface during operations before, during and after completion of the well, such as during drilling, perforating, fracturing and well testing operations. In addition, control information often is communicated from the surface to various downhole components to enable, control or modify the downhole operations.

Accurate and reliable communications between the surface and downhole components during operations can be difficult. Wired, or wireline, communication systems can be used in which electrical or optical signals are transmitted via a cable. However, the cable used to transmit the communications generally has complex connections at pipe joints and to traverse certain downhole components, such as packers. In addition, the use of a wireline tool is an invasive technique which can interrupt production or affect other operations being performed in the wellbore. Thus, wireless communication systems can be used to overcome these issues.

In a wireless system, information is exchanged between downhole components and surface systems using acoustic or electromagnetic transmission mediums. As an example, a network of acoustic devices can be deployed downhole that uses the tubing as the medium for transmitting information acoustically. To ensure that communications from all devices reach the surfaces, an acoustic network is generally arranged as a series of repeaters. That is, communications from devices furthest from the surface are received and passed on by neighboring devices that are closer to the surface. Likewise, communications from the surface that are directed to the furthest removed devices are received and passed on by intermediate devices. Because of this series arrangement where the communication path is dependent on neighboring devices, a single point of failure can disrupt the communications network.

SUMMARY

Certain aspects of some embodiments disclosed herein are set forth below. It should be understood that these aspects are presented merely to provide the reader with a brief summary of certain forms the embodiments might take and that these aspects are not intended to limit the scope of the disclosure. Indeed, the disclosure may encompass a variety of aspects that may not be set forth below.

In some embodiments, a method of communicating with downhole equipment in a borehole is provided. In some embodiments, the method includes exchanging messages between a surface control system and downhole equipment to control performance of a downhole operation, where the messages are exchanged via a first communications path that includes a wireless communications path between a plurality of wireless devices provided along a tubing in the borehole. In response to an inability to exchange messages via the first communications path while performing the downhole operation, a master communications device is deployed to establish an alternative communications path between the surface control system and the downhole equipment, the alternative communications path including a wireless communication link between the master communications device and a first wireless device of the plurality of wireless devices. The method also includes continuing performing the downhole operation using the alternative communications path to exchange messages between the surface control system and the downhole equipment to control the downhole operation.

In some embodiments a method includes establishing an acoustic communications path between equipment and a control system, the acoustic communications path comprising a plurality of acoustic modems deployed along a conduit. The method also includes communicating messages via the acoustic communications path between the equipment and the control system and establishing a different communications path between the equipment and the control system. The different communications path includes at least a first acoustic modem and a second acoustic modem of the plurality of the acoustic modems and a wireless communications link between a mobile master modem located within a wireless range of one of the first acoustic modem and the second acoustic modem. The method also includes communicating messages via the different communications path between the equipment and the control system.

In some embodiments, a communication system for communicating with downhole equipment in a wellbore is provided. The communication system includes a control system to exchange messages with the downhole equipment to control performance of a downhole operation and a network of wireless modems located along a tubing deployed in the wellbore, the network providing a primary communications path between the control system and the downhole equipment. A message from the downhole equipment is wirelessly received on the primary communications path by at least a first modem and wirelessly repeated on the primary communications path by at least a second modem of the network. The communication system also includes a mobile master modem in communication with the control system in which, when the mobile master modem is moved within a wireless range of one of the first and second modems in response to detection of a failure of the primary communications path during performance of the downhole operation, a wireless communications link is established between the mobile master modem and the corresponding one of the first and second modems so that messages between the downhole equipment and the control system for controlling the downhole operation are transmitted through the mobile master modem and bypass at least a portion of the primary communications path.

BRIEF DESCRIPTION OF THE DRAWINGS

Certain embodiments are described with reference to the accompanying drawings, wherein like reference numerals denote like elements. It should be understood, however, that the accompanying drawings illustrate the various implementations described herein and are not meant to limit the scope of various technologies described herein. The drawings show and describe various embodiments.

DETAILED DESCRIPTION

Figure 1:
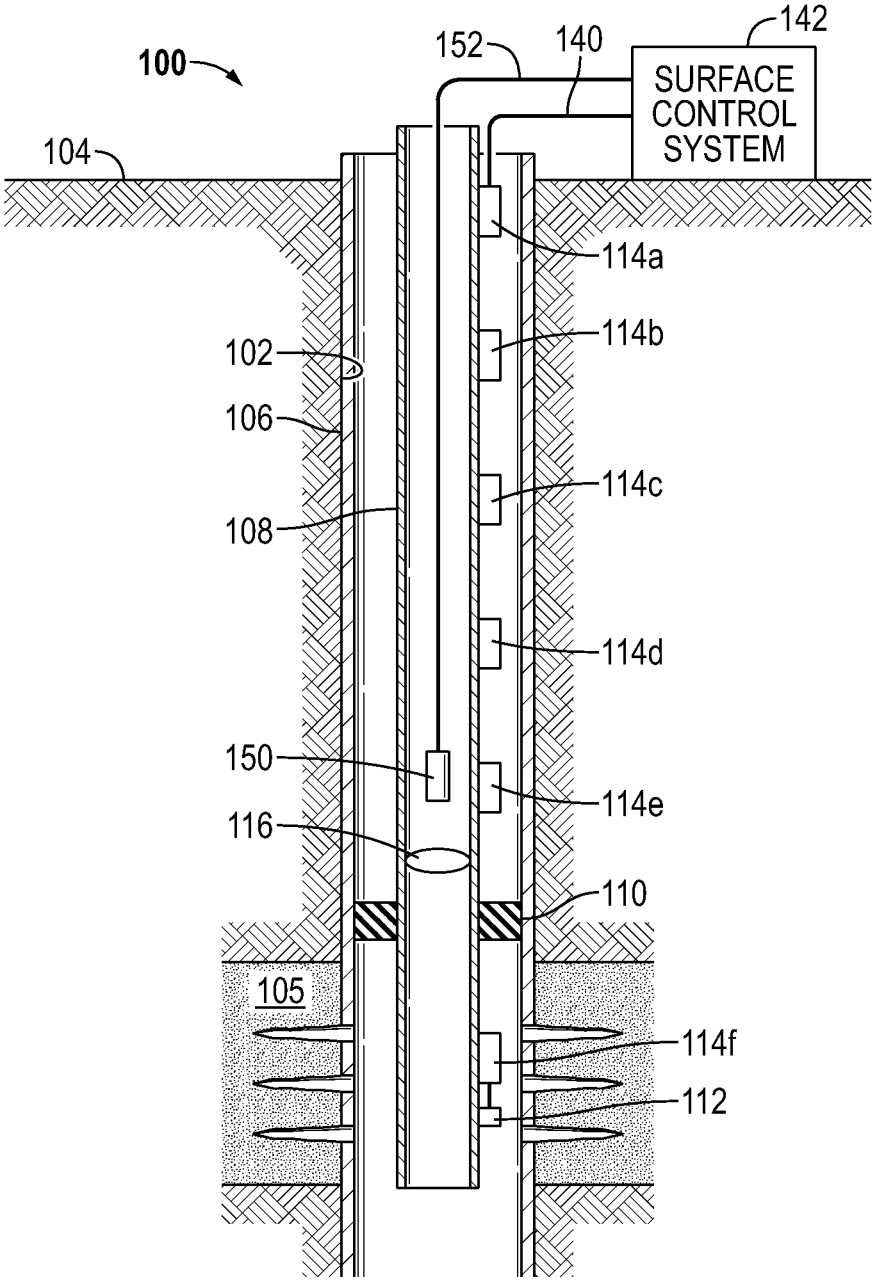
FIG. 1 is a schematic illustration of a communications network of wireless modems in communication with a master communication tool, in accordance with an embodiment.

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments.

Communication systems for transmitting information between the surface and downhole components are faced with numerous challenges. As just one example, the harsh conditions of downhole environments can affect reliability and longevity of such systems. Thus, a backup plan to provide an alternative communications path can be useful to ensure that communications between the surface and the downhole components can be achieved and operations proceed uninterrupted even after some components fail.

Providing such a backup plan can be particularly challenging when the communication system is a distributed network of wireless devices. Wireless communication signals between surface systems and devices located furthest from the surface generally lack the strength to reach their destination. As such, an intermediary device often is used to repeat and amplify (or boost) the signal. However, should an intermediate device fail, communications with devices that communicate through failed device also will be disrupted. To re-establish communications, an alternative communication path that bypasses the failure point can be useful.

Acoustic modems are one type of wireless device that can be used to establish a downhole communication network. In general, acoustic modems use a pipe string (or tubing) as the transmission medium. Typically, the communication network is established by connecting a plurality of acoustic modems to tubing at spaced apart locations along the string. Each modem includes a transducer that can convert an electrical signal to an acoustic signal (or message) that is then communicated using the tubing as the transmission medium. An acoustic modem within range of a transmitting modem receives the acoustic message and processes it. If the message is addressed for another device, then the receiving modem amplifies it and acoustically retransmits it along the tubing. This process repeats until the communication reaches its intended destination.

A schematic illustration of an arrangement 100 in which a network of acoustic modems is deployed is illustrated in FIG. 1. In FIG. 1, a wellbore 102 is drilled that extends from a surface 104 and through a hydrocarbon-bearing formation or other region of interest 105. Once the wellbore 102 is drilled, a casing 106 is lowered into the wellbore 102. Although a cased vertical well structure is shown, it should be understood that embodiments of the subject matter of this application are not limited to this illustrative example. Uncased, open hole, gravel packed, deviated, horizontal, multi-lateral, deep sea or terrestrial surface injection and/or production wells (among others) can incorporate a network of acoustic modems as will be described herein.

To test the formation, testing apparatus can be placed in the well in the proximity of the region of interest 105 so as to isolate sections of the well and to convey fluids from the region of interest to the surface. Typically, this is done using a jointed tubular drill pipe, drill string, production tubing, etc. (e.g., tubing 108) that extends from the surface equipment to the region of interest 105 in the wellbore 102.

A packer 110 can be positioned on the tubing 108 and can be actuated to seal the wellbore 102 around the tubing 108 at the region of interest. Various pieces of downhole test equipment are connected to the tubing 108 above or below the packer 110. Downhole equipment can include, for example, additional packers, valves, chokes, firing heads, perforators, samplers, pressure gauges, temperature sensors, flow meters, fluid analyzers, etc. In the embodiment shown, the downhole equipment includes a pressure sensor 112 located below the packer 110 and a valve 116 located above the packer 110.

In FIG. 1, a plurality of acoustic communication devices 114*a-f* (generally referred to herein as modems) are located along the tubing 108. In some embodiments, the modems 114 can be mounted in a carrier which is attached to the tubing, although other mounting arrangements, including direct mounting connections, are possible and contemplated. A valve 116 is located above the packer 110, and modems 114*a-e* are located above the valve 116. The modem 114*f* is located below the packer 110 and the valve 116. In the example, the acoustic modem 114*f* is connected to downhole equipment 112 (e.g., a sensor) and operates to allow electrical signals from the downhole equipment 112 to be converted into acoustic signals for transmission to the surface 104 via the tubing 108 and the other modems 114*a-e*. The modems 114 also convert acoustic control signals transmitted from the surface 104 via the tubing 108 to electrical signals for operating downhole equipment, such as the downhole equipment 112, the valve 116, etc., in order to control the performance of a downhole operation. The signals transmitted between the acoustic modems 114 and the surface 104 can encompass control signals, commands, polls for data, data regarding tool status, data indicative of parameters monitored by sensors, etc., and can be transmitted between the modems 114 and the downhole equipment 112 as either digital or analog signals. Although the modem 114*f* in this example is communicatively coupled with downhole equipment 112 and the modem 114*e* is communicatively coupled with the valve 116, it should be understood that any one or all of the modems 114*a-f* can be communicatively coupled with different downhole components, such as other valves (including test valves, circulation valves, etc.), other sensors (including temperature sensors, pressure gauges, flow meters, fluid analyzers, etc.), and any other downhole tools used in the performance of a downhole operation (including packers, chokes, firing heads, tubing conveyed perforator gun drop subs, etc.).

Figure 2:
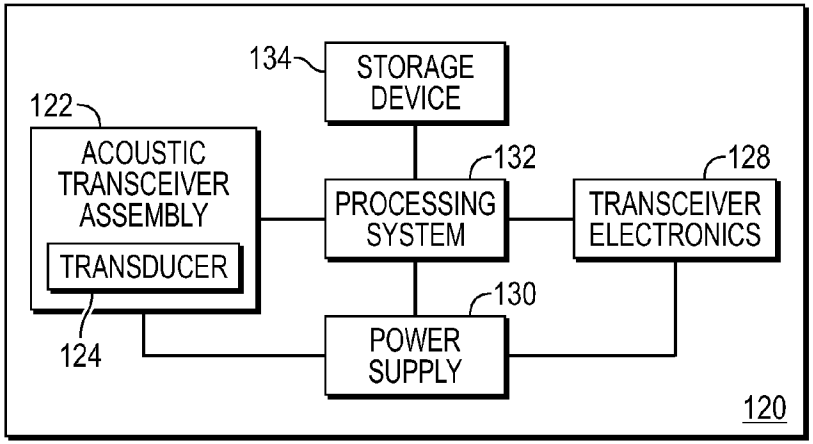
FIG. 2 is a block diagram of a wireless modem that can be used in the network of FIG. 1, in accordance with an embodiment.

A schematic illustration of a modem 114 is shown in FIG. 2. Modem 114 includes a housing 120 that supports an acoustic transceiver assembly 122 that includes electronics and a transducer 124 which can be driven to create an acoustic signal in the tubing 108 and/or excited by an acoustic signal received from the tubing 108 to generate an electrical signal. The transducer 124 can include, for example, a piezoelectric stack, a magneto restrictive element, and or an accelerometer or any other element or combination of elements that are suitable for converting an acoustic signal to an electrical signal and/or converting an electrical signal to an acoustic signal. The modem 114 also includes transceiver electronics 128 for transmitting and receiving electrical signals. Power can be provided by a power supply 130, such as a lithium battery, although other types of power supplies are possible.

The transceiver electronics 128 are arranged to receive an electrical signal from a sensor that is part of the downhole equipment 112. The electrical signal can be in the form of a digital signal that is provided to a processing system 132, which can modulate the signal in a known manner, amplify the modulated signal as needed, and transmit the amplified signal to the transceiver assembly 122. The transceiver assembly 122 generates a corresponding acoustic signal for transmission via the tubing 108. The transceiver assembly 122 of the modem 114 also is configured to receive an acoustic signal transmitted along the tubing 108, such as by another modem 114. The transceiver assembly 122 converts the acoustic signal into an electric signal. The electric signal then can be passed on to processing system 132. In various embodiments, the processing system 132 can include, for example, a signal conditioner, filter, analog-to-digital converter, demodulator, modulator, amplifier, microcontroller, etc. The modem 114 can also include a memory or storage device 134 to store data received from the downhole equipment so that it can be transmitted or retrieved from the modem 114 at a later time.

Thus, a modem 114 can operate to transmit acoustic data from the downhole equipment 112 along the tubing 108. The modem 114 can also operate to receive acoustic control signals to be applied to the downhole equipment 112.

Returning to FIG. 1, in order to support transmission of an acoustic signal along the tubing 108 between, for instance, the modem 114*f* and the surface, a series of modems 114*a-e* are placed along the tubing 108. In this arrangement the modem 114*e* operates to receive an acoustic signal generated in the tubing 108 by the modem 114*f* and to amplify and retransmit the signal for further propagation along the tubing 108. The number and spacing of the acoustic modems 114*a-f* will depend on the particular installation. For instance when implemented in a well, the spacing between modems 114*a-f* will be selected to accommodate particular testing tool configurations and will further depend on the presence and type of fluid in the well, the characteristics of the tubing 108 to which the modems 114*a-f* are coupled, the configuration and power of the transceiver assembly 122, as well as other parameters that affect the operable range of modems 114*a-f*. When a modem 114 is operating as a repeater, the acoustic signal can be received, converted to an electrical signal, processed, amplified, converted to an acoustic signal and retransmitted along the tubing 108. In some embodiments, a modem 114 can simply detect the incoming acoustic signal, amplify it (including the noise) and transmit the amplified acoustic signal. In such embodiments, the modem 114 effectively is acting as a signal booster. But, in either case, communications between the surface and the downhole modems 114 is effectuated as a series of short hops.

The acoustic modems 114*a-f* can be configured to listen continuously for incoming acoustic signals or can listen periodically. An acoustic signal transmitted by a modem 114 is broadcast and is omni-directional. Thus, multiple modems 114*a-f* can receive a particular signal and not just the modem 114 immediately adjacent the transmitting modem. As such, the acoustic signal (or message) typically includes address information so that a receiving modem 114 can determine both the source and the destination of the message and process and/or forward and/or ignore the message as may be appropriate.

Referring again to FIG. 1, the modem 114*a* is located closest to the surface 104 and is coupled via a data cable or a wireless connection 140 to a surface control system 142 that can receive, store, process, and/or interpret data from the downhole equipment (e.g., sensor 112) and provide control signals for operation of the downhole equipment (e.g., valve 116). While the embodiment in FIG. 1 is shown as a completed well, it should be understood that other embodiments can be implemented other stages of the life of the well. For instance, the systems and techniques described herein can be implemented during downhole operations performed during drilling, logging, drill stem testing, fracturing, stimulation, completion, cementing, production and even after the well has been shut in.

Regardless of the particular application, a difficulty with an arrangement of modems that propagate communications in a series of hops can be that the failure of a single modem in the series can result in the inability to continue to communicate between the surface and the modems that communicate through the failed modem. Such a failure can occur, for example, it a modem loses power, if the transceiver electronics fail, if the communications path between modems cannot be established or fails, if the communication connection between the modem closest to the surface and the surface equipment breaks or otherwise fails, etc. Such a failure can be costly if it occurs during performance of a downhole operation. In many instances, failure of the communications path between the downhole equipment and the surface control system means that operations are stopped for substantial periods of time until the communications path can be restored. Accordingly, an alternative communications path between any point of failure and the surface that can be established quickly can be useful to ensure that the modem network can function even in the face of a failure and, thus, that downhole operations can continue virtually uninterrupted. Embodiments of the systems and techniques described herein are directed to providing such an alternative path.

FIG. 1 shows one example of an alternative communications path that can be implemented in various embodiments. In FIG. 1, modem 114*f* is located below the packer 110 and is coupled to a sensor 112 that monitors real-time pressure in the region of interest 105. The sensor 112 generates electrical signals (or data) that is representative of the monitored pressure and conveys the signals to the acoustic modem 114*f*. The modem 114*f* processes the data and converts it to an acoustic message that is addressed to the surface system 142. The modem 114*f* transmits the acoustic message using the tubing 108 as the transmission medium. In this example, the modem 114*e* receives the acoustic message, amplifies it and retransmits it along the tubing 108. Modem 114*d* receives the message and repeats the process. If the network of modems 114*a-f* is operating properly, the acoustic message ultimately is delivered to the surface system 142.

In the event of a failure in the network of modems 114*a-f*, an alternative communication path between the modems 114*a-f* (or at least a subset of the modems 114*a-f*) and the surface system 142 is established by deploying a master communication tool 150. The master communication tool 150 is generally referred to herein as a master modem, but can be any type of communication tool that is configured to establish a wireless communication link with a wireless device 114 (e.g., acoustic modem) so that messages can be exchanged between the wireless device 114 and the surface system 142. The master modem 150 is configured in substantially the same manner as modems 114*a-f*, but is configured to be mobile. In the example illustrated in FIG. 1, the master modem 150 is connected via wireline 152 to the surface system 142 and can be lowered and raised in the wellbore via the wireline 152. In some embodiments, the wireline 152 comprises electrical conductors suitable for conducting electrical signals between the surface system 142 and the master modem 150. In other embodiments, the wireline 152 can comprise an optical fiber so that communications between the master modem 150 and the surface system 142 are implemented through the exchange of optical signals.

Figure 3:
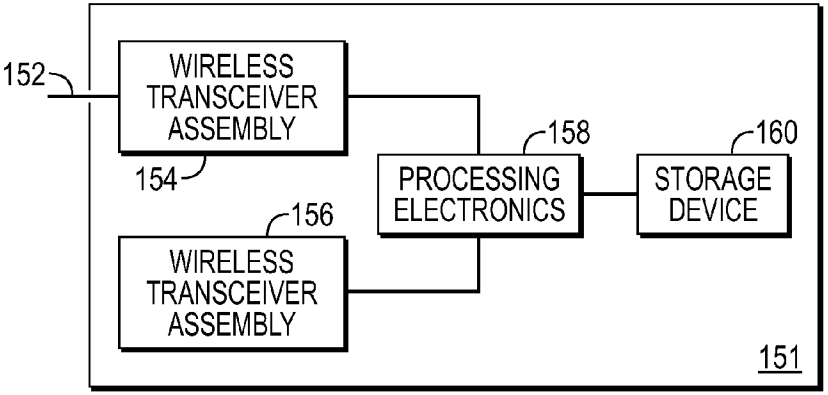
FIG. 3 is a block diagram of a master communication tool that can be used in the network of FIG. 1, in accordance with an embodiment.

In any event, and with reference to FIG. 3, the master modem 150 includes wireline transceiver electronics 154 supported within a housing 151 that are suited to send and receive communications via the wireline 152. The master modem 150 also includes wireless transceiver assembly 156 that is configured to exchange wireless communications, such as acoustic signals or messages, with any of the modems 114*a-f* in the network. The transceiver assembly 156 can include a transducer for converting an electrical signal to an acoustic signal and vice versa. The master modem 150 also includes processing electronics 158 connected to the wireless transceiver assembly 156 and the wireline transceiver electronics 154. The processing electronics 158 can include, for example, a signal conditioner, filters, an analog-to-digital converter, a digital-to analog converter, a modulator, a demodulator, a microcontroller, etc., as is appropriate to receive, process, convert, and transmit wireline signals and wireless signals between the master modem, the surface system 142 and any of the wireless modems 114*a-f*.

The master modem 150 can also include a memory or storage device 160 that can store data received from any modem 114 with which the master 150 can communicate. In some embodiments, the master modem 150 can also include a power source. In other embodiments, power can be provided via the wireline cable 152.

Referring back to FIG. 1, upon detection of a failure of the communications network (such as by detecting that messages that are being used to control a downhole operation no longer are being received from or responded to by downhole equipment during the performance of the operation), the master modem 150 is deployed into the wellbore 102. If the point of failure is known, the master modem 150 can be deployed within the vicinity of a wireless modem 114*a-f* that is closest to the failure point. Thus, for instance, if the surface system 142 cannot communicate with modem 114*a*, a failure of the connection between the modem 114*a* and the surface system 142 may be indicated. The master modem 150 can then be positioned in the wellbore 102 within the effective range of the known location of the modem 114*a*. Likewise, if the surface system 142 cannot control operation of the valve 116 or receive data from the sensor 112, this situation can be indicative of a failure in the communications path between modems 114*a* and 114*e*. In this case, the master modem 150 can then be positioned in the wellbore 102 within the effective range of the known location of the modem 114*e*.

When the master modem 150 is within range of the modem 114*e*, a wireless communication link can be established between the master modem 150 and the modem 114*e*. For instance, the surface system 142 can generate an electrical control signal that is provided to the master modem 150. The master modem 150 can convert the electrical control signal to an acoustic signal that it then transmits via the wireless transceiver assembly 156 using, for instance, fluid present in the tubing 108 as the transmission medium. In other embodiments, the master modem 150 can be configured to continuously or periodically broadcast a polling signal via the wireless transceiver assembly 156 until it receives a response from a modem 114 acknowledging receipt of the poll. The wireless communications link between the master modem 150 and the acknowledging modem 114 can then be established.

If communications with the modem 114*e* can be established, then the master modem 150 can be used to complete the communication path between the surface system 142 and the modem 114*e*, as well as any of the modems 114*b-f* that can communicate with the surface system 142 through the modem 114*e*. If communications cannot be established with modem 114*e*, then the master modem 150 can be repositioned within range of another modem 114, such as modem 114*d*. This process can be repeated until a communications link is successfully completed between the master modem 150 and one of the modems 114*a-e*. Once the communications link is completed, then performance of the downhole operation can be continued.

Figure 4:
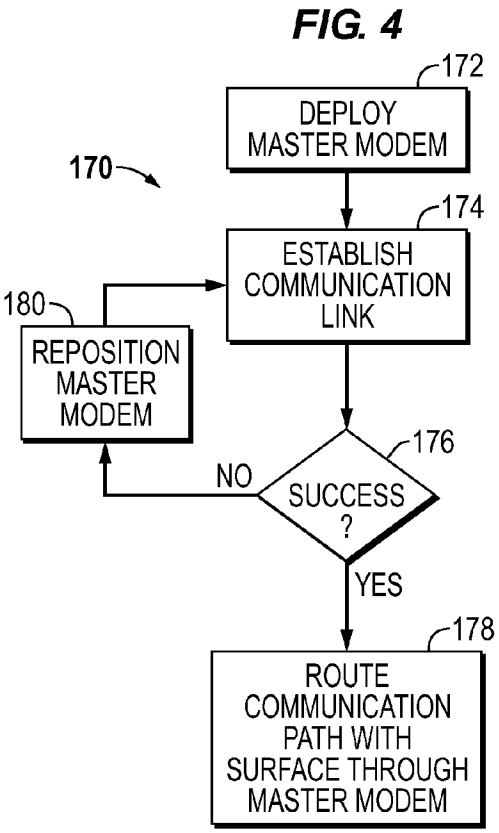
FIG. 4 is a flow diagram of a technique for establishing an alternative communications path using a master communication tool, in accordance with an embodiment.

FIG. 4 illustrates a flow diagram of a process 170 for establishing an alternative communications path with the surface system 142 using a master modem 150. At block 172, the master modem 150 is deployed in the vicinity of a modem 114. At block 174, the master modem 150 attempts to establish the communications link with the modem 114. For instance, the master modem 150 can wirelessly transmit a polling signal or message and then listen for a response from a modem 114 acknowledging receipt of the message. If the link is successfully established (e.g., an acknowledgement is received) (block 176), the modem 150 establishes the link with the modem 114 and communications with the surface are then routed through the master modem 150 (block 178). If, at block 176, a link cannot be established with a modem 114 (e.g., after elapse of a given time period), then the master modem 150 is repositioned (block 180) and attempts again to establish a link with a modem 114. This process can repeat until either a link is established or sufficient time has elapsed or a sufficient number of attempts have been made that it is determined that an alternative communication path cannot be set up using the master modem 150.

In other embodiments, the master modem 150 can be deployed and used to establish a communications path between downhole modems 114 before the communications network has been completely established. For example, in hydrocarbon wells, downhole pressure tests are often performed at stops made while tubing 108 is being lowered into the wellbore. In such an arrangement, the master modem 150 can be used to establish a temporary communications path between downhole modems 114 and the surface system 142.

Figure 5:
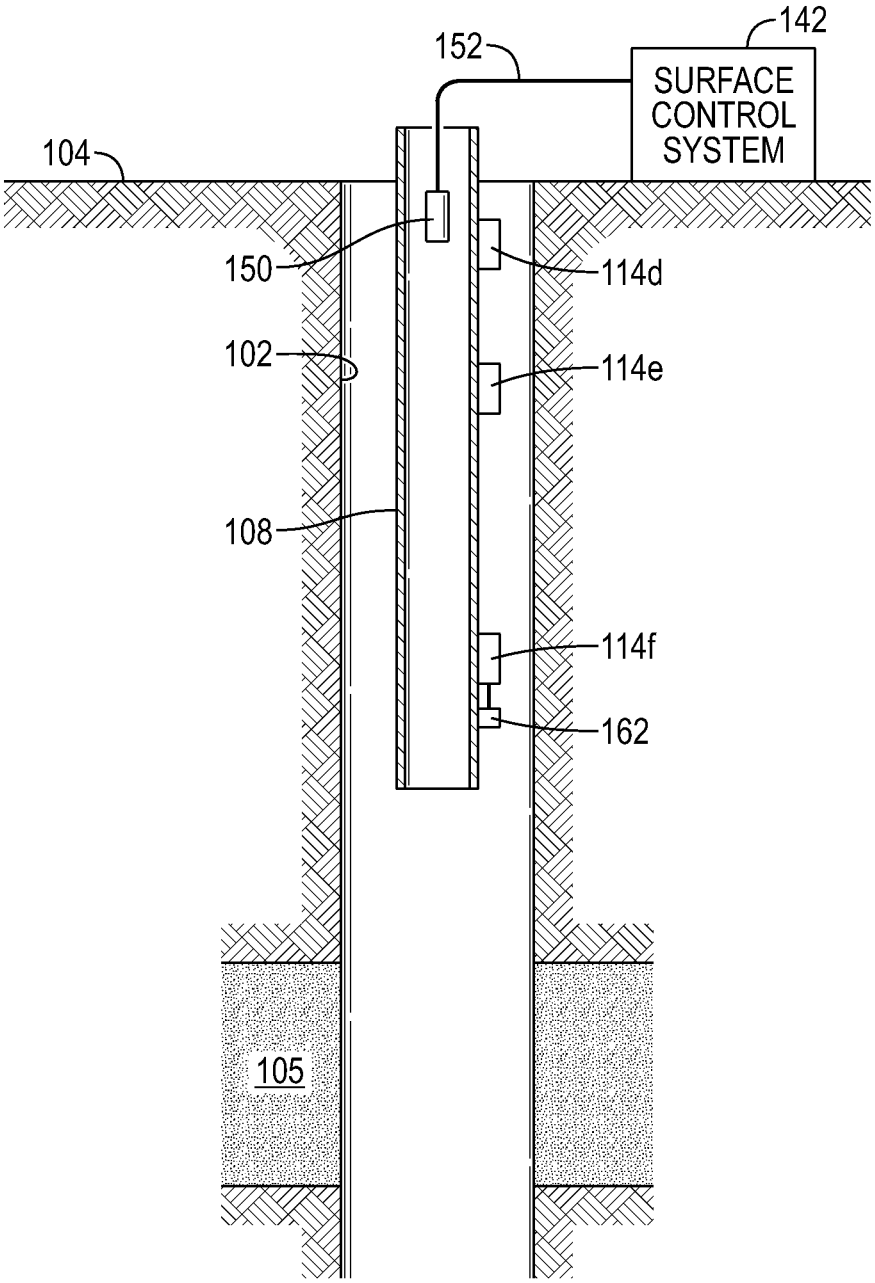
FIG. 5 is a schematic illustration of another communications network of wireless modems in communication with a master communication tool, in accordance with an embodiment.

FIG. 5 provides a schematic illustration of an arrangement where a temporary communications path is established via the master modem 150 at a stop made during the run in hole (RIH). In FIG. 5, acoustic modems 114*d-f* are shown attached to the tubing 108, which has been partially lowered into the wellbore 102. The run of the tubing 108 has been stopped so as to measure downhole pressure using a sensor 162 (e.g., a pressure sensor, a temperature sensor, etc.) that is in communication with the modem 114*f*. Because the tubing 108 is partially deployed, a permanent communications path between the modems 114*d-f* and the surface system 142 via the tubing 108 has not yet been initialized or established. However, a temporary path can be established by placing a master modem 150 at or near the surface 104. The master modem 150, which is in communication with the surface system 142 via the line 152 (e.g., a data cable, wireless link, etc.), attempts to establish a wireless (e.g., acoustic) communication link with the latest modem 114 deployed in the wellbore (e.g., modem 114*d* in FIG. 5).

Once the link is established, the surface system 142 can communicate with any downhole modems 114 that have a communications path through modem 114*d*. Thus, for instance, if the modem 114*f* is configured to obtain data representative of downhole parameters (e.g., temperature, pressure) from sensor 162, then a query for the data can be transmitted from the surface system 142 through the master modem 150 and to the modem 114*d*, which then passes on the query to the modem 114*f* via the tubing 108. Likewise, the modem 114*f* can respond with the data by sending an acoustic message via the tubing 108 to the modem 114*d* (boosted, as may be needed, by the modem 114*e*). The modem 114*d* passes the message on to the master modem 150, which relays the message with the data to the surface system 142 via the connection 152.

Figure 6:
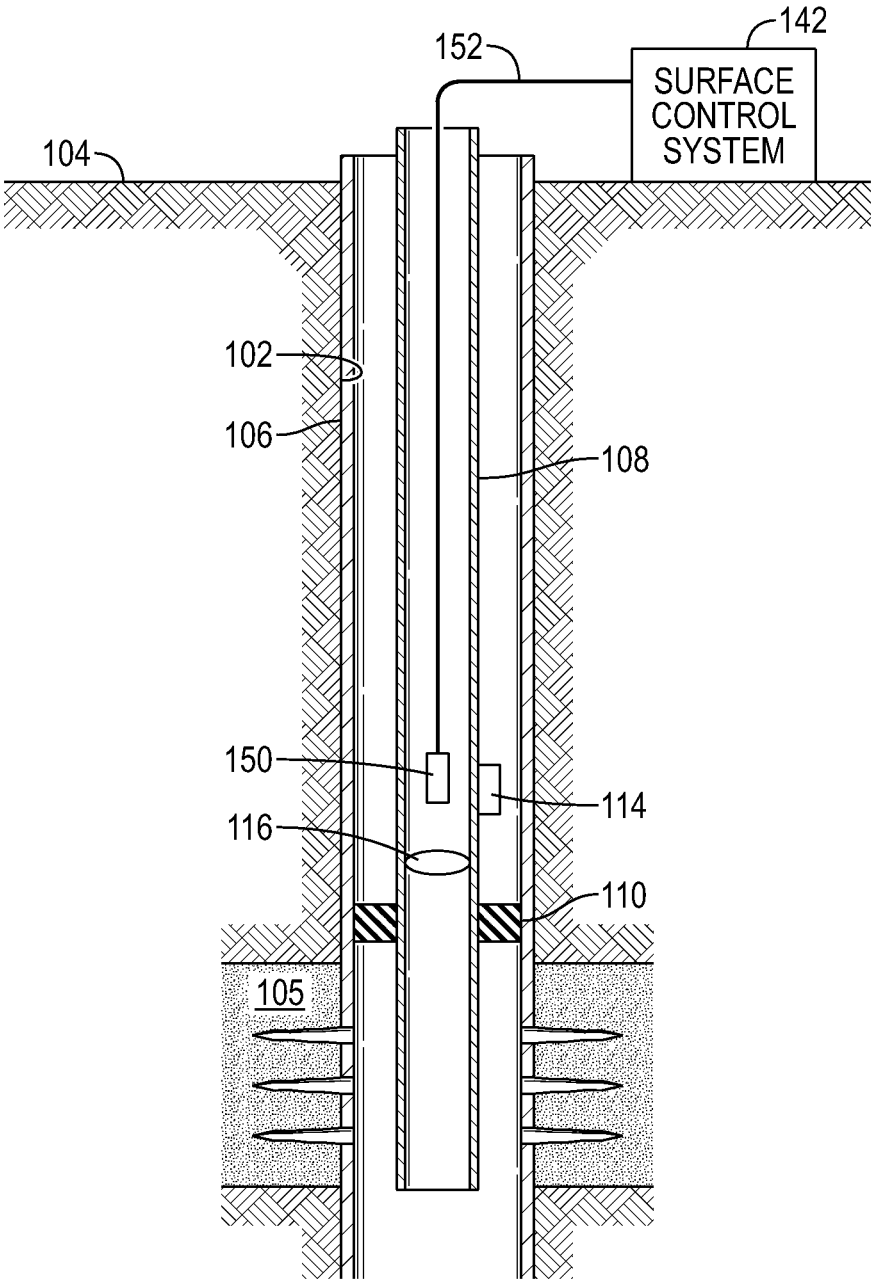
FIG. 6 is a schematic illustration of another communications path established between a master communication tool and a wireless modem, in accordance with an embodiment.

FIG. 6 provides a schematic illustration of yet another example where the master modem 150 is deployed in a wellbore to establish a communications path between a modem 114 and the surface system 142 via the connection 152. In FIG. 6, a single modem 114 is attached to the tubing 108, which could occur, for example, after a well has been abandoned and surface production equipment has been removed. However, by deploying the master modem 150 in conjunction with a surface control system 142 as shown in FIG. 6, data can be retrieved from the modem 114 at any later time. Although a single modem 114 is illustrated, more than one modem 114 can be attached to the tubing 108, and the master modem 150 can be deployed to communicate and exchange messages with, including retrieving data from, any one or all of the modems 114.

The embodiments discussed above have involved applications in land-based hydrocarbon-producing wells. However, the master modem communication techniques also can be applied in wells that extend into a seabed. The use of the master modem 150 in offshore applications can be particularly useful since the integrity of a communication cable deployed in the sea can be compromised more readily than an on-shore communication cable. An example of such an application is schematically illustrated in FIG. 6.

Figure 7:
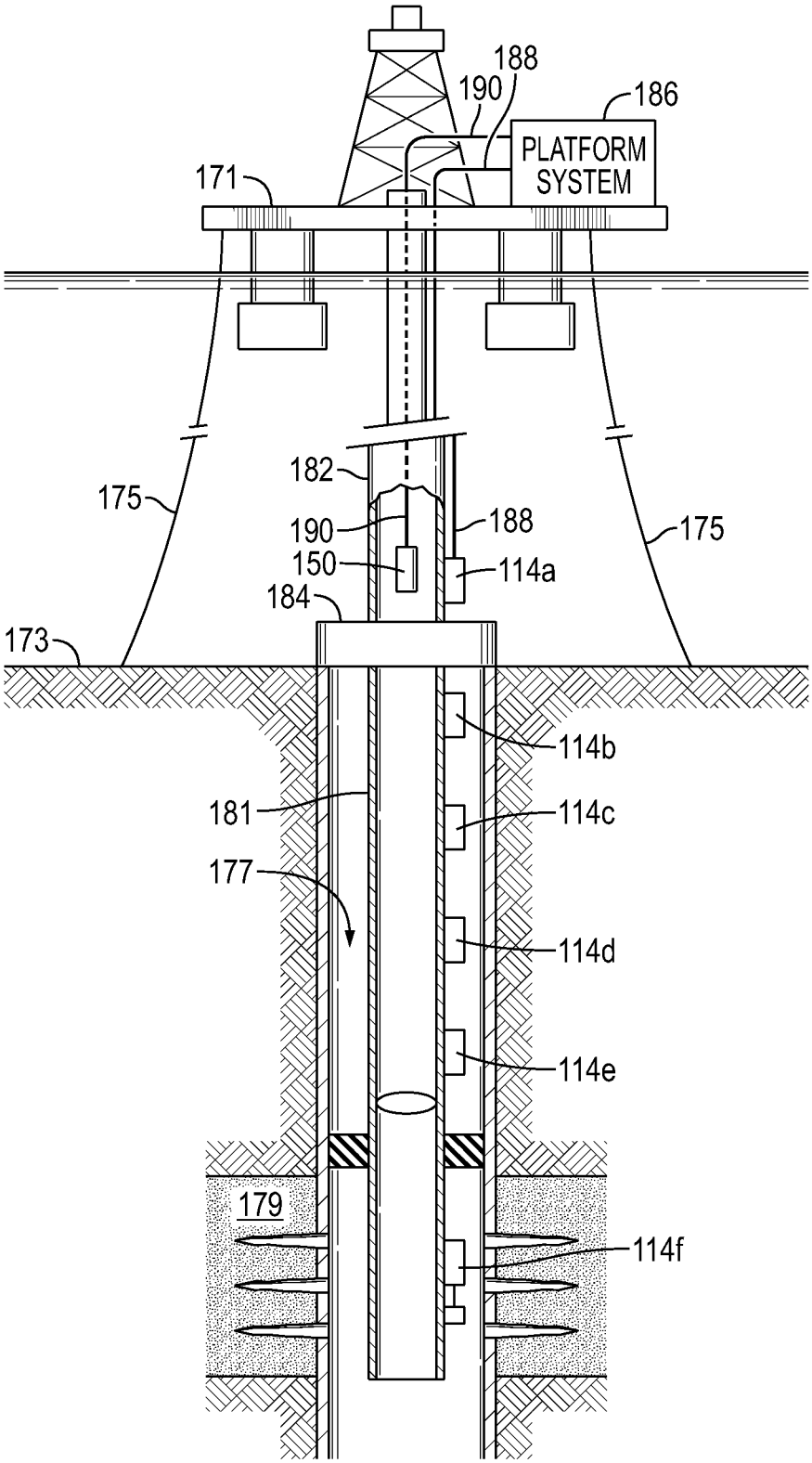
FIG. 7 is a schematic illustration of yet another communications network of wireless modems in communication with a master communication tool, in accordance with an embodiment.

In FIG. 7, an offshore platform 171 that is attached to the seabed 173 via tethers 175 is positioned above a wellbore 177 that extends from the seabed 173 into a hydrocarbon-bearing formation 179. The well is completed with a production tubing 181 to which acoustic modems 114*b-f* are connected to form a communication network. The production tubing 181 is connected at the seabed 173 to a riser 182 that extends from a wellhead 184 to the platform 171. An acoustic modem 114*a* is connected to the riser 182 above the wellhead 184 and is in communication with a platform system 186 via a sea communication cable 188.

In the example of FIG. 7, the communication network has been fully deployed and the communications link between the modems 114*a-f* and the platform system 186 has been established. If communications between the platform system 186 and the seabed modems 114*a-f* are lost, then the master modem 150 can be deployed via wireline 190 through the riser 182 to a location within the acoustic range of one or more of the modems 114*a* and 114*b*. Again, the acoustic range will depend on the transmission medium (e.g., seawater, hydrocarbon fluid, etc.) in the riser 182, the transmission and reception capabilities of the transceiver electronics of the master modem 150 and the seabed modems 114*a-f*, and other factors. Once the master modem 150 is within range, the master modem 150 can attempt to establish a wireless communication link with one or both of modems 114*a* and 114*b*. When this wireless link is successfully established, communications can be re-established between the platform system 186 and any of the modems 114 that communicate through modem 114*a* and/or 114*b*.

Although the embodiments have been discussed above with reference to acoustic modems, it should be understood that the master modem techniques and arrangements disclosed herein are not limited to acoustic applications, but are applicable in other wireless contexts, such as modems that communicate via a radio frequency (RF) link, inductive coupling, etc. In addition, the master modem techniques can be applied in a variety of network configurations and are not limited to a simple series of repeaters as discussed in the embodiments. For instance, the modems in the network can be located so that multiple modems are within communication range of other modems. Thus, the network may include redundant communication paths so that failure of any one modem is not a single point of failure. Nonetheless, the master modem arrangement can still provide benefit as an alternative to the redundant paths or in the event that multiple failures occur in the network such that even the redundant paths fail. The techniques and arrangements discussed herein also are not limited to use in a wellbore, but can be applied with any network of wireless devices where an alternative communications path or a temporary communications path is desired.

Although the preceding description has been described herein with reference to particular means, materials and embodiments, it is not intended to be limited to the particulars disclosed here; rather, it extends to all functionally equivalent structures, methods and uses, such as are within the scope of the appended claims.

The invention claimed is:

1. A method of communicating with downhole equipment in a borehole, comprising:

exchanging messages between a surface control system and downhole equipment to control performance of a downhole operation, wherein the messages are exchanged via a first communications path that includes a wireless communications path between a plurality of wireless devices provided along a tubing in the borehole;

in response to an inability to exchange messages via the first communications path while performing the downhole operation, deploying a master communications device to establish an alternative communications path between the surface control system and the downhole equipment, the alternative communications path including a wireless communication link between the master communications device and a first wireless device of the plurality of wireless devices; and continuing performing the downhole operation using the alternative communications path to exchange messages between the surface control system and the downhole equipment to control the downhole operation;

wherein deploying the master communications device in the borehole comprises:

positioning the master communications device at a first location corresponding to a wireless range of a wireless device;

continuously or periodically broadcasting a polling signal with the master communications device until the master communications device receives a response by a wireless device acknowledging receipt of the polling signal;

establishing the wireless communications link between the master communications device and the wireless device acknowledging receipt of the polling signal; and moving the master communications device to a second location within a wireless range of another wireless device if the alternative communications path cannot be established at the first location.

2. The method as recited in claim 1, wherein the master communications device is acoustically coupled to the first wireless device and electrically coupled to the control system.

3. The method as recited in claim 1, wherein a second wireless device of the plurality of wireless devices is acoustically coupled to the first wireless device and electrically coupled to the surface control system.

4. A method, comprising:

establishing a first acoustic communications path between equipment and a control system, the acoustic communications path comprising a plurality of acoustic modems deployed along a conduit;

communicating messages via the acoustic communications path between the equipment and the control system;

establishing a different communications path between the equipment and the control system, the different communications path comprising at least a first acoustic modem and a second acoustic modem of the plurality of the acoustic modems and a wireless communications link between a mobile master modem located within a wireless range of the first acoustic modem; and communicating messages via the different communications path between the equipment and the control system wherein establishing a different communications path between the equipment and the control system comprises:

deploying the mobile master modem in a wellbore at a first location corresponding to the wireless range of the first acoustic modem;

continuously or periodically broadcasting a polling signal with the mobile master modem until the mobile master modem receives a response from the first acoustic modem acknowledging receipt of the polling signal;

establishing the wireless communications link between the mobile master modem and the first acoustic modem; and moving the mobile master modem to a second location within a wireless range of the second acoustic modem if the alternative communications path cannot be established at the first location.

5. The method as recited in claim 4, wherein the wireless communications link between the mobile master modem and the first acoustic modem is an acoustic communications link.

6. The method as recited in claim 4, further comprising:

initiating deployment of the conduit in the wellbore;

stopping the deployment of the conduit when a subset of the acoustic modems is positioned in the wellbore;

establishing a temporary communications path between the equipment and the control system to communicate messages via the temporary communications path while the deployment is stopped, wherein the temporary communications path comprises the mobile master modem and at least one acoustic modem of the subset of the acoustic modems; and continuing deployment of the conduit in the wellbore, wherein the temporary communications path is established before the acoustic communications path has been initialized.

7. The method as recited in claim 6, further comprising:

moving the mobile master modem outside of a wireless range of the acoustic modems; and communicating messages between equipment and the control system via the acoustic communications path.

8. The method as recited in claim 6, wherein the equipment comprises a sensor to monitor at least one of pressure and temperature in the wellbore.

9. The method as recited in claim 4, further comprising:

performing an operation while communicating messages between the equipment and the control system via the acoustic communications path;

in response to an inability to communicate messages between the equipment and the control system, establishing the different communications path; and continuing performance of the operation by communicating messages between the equipment and the control system via the different communications path.

10. The method as recited in claim 4, wherein the mobile master modem is electrically coupled to the control system.

11. A communication system for communicating with downhole equipment in a wellbore, comprising:

a control system to exchange messages with the downhole equipment to control performance of a downhole operation;

a network of wireless modems located along a tubing deployed in the wellbore, the network providing a primary communications path between the control system and the downhole equipment, wherein a message from the downhole equipment is wirelessly received on the primary communications path by at least a first modem and wirelessly repeated on the primary communications path by at least a second modem of the network; and a mobile master modem in communication with the control system wherein when the mobile master modem is moved within a wireless range of one of the first and second modems in response to detection of a failure of the primary communications path during performance of the downhole operation, a wireless communications link is established between the mobile master modem and the corresponding one of the first and second modems so that messages between the downhole equipment and the control system for controlling the downhole operation are transmitted through the mobile master modem and bypass at least a portion of the primary communications path, wherein the mobile master modem is configured to:

continuously or periodically broadcast a polling signal until the mobile master modem receives a response by one of the first and second modems acknowledging receipt of the polling signal; and establish the wireless communications link with the modem acknowledging receipt of the polling signal.

12. The system as recited in claim 11, wherein the primary communications path is acoustic communications path.

13. The system as recited in claim 11, wherein the wireless communications link is an acoustic communications link.

14. The system as recited in claim 11, wherein the mobile master modem is electrically connected to the control system.

15. The system as recited in claim 11, wherein the wellbore penetrates a hydrocarbon-bearing formation, and wherein the downhole equipment comprises one of a sensor to monitor pressure in the wellbore and a valve to control fluid flow through the tubing.

16. The system as recited in claim 15, wherein the wellbore extends through a seabed and into the hydrocarbon-bearing formation.

* * * * *